US010655528B2

(12) United States Patent
Larsson

(10) Patent No.: US 10,655,528 B2
(45) Date of Patent: May 19, 2020

(54) METHOD OF OPERATING AN INTERNAL COMBUSTION ENGINE

(71) Applicant: VOLVO TRUCK CORPORATION, Göteborg (SE)

(72) Inventor: Per Larsson, Billdal (SE)

(73) Assignee: VOLVO TRUCK CORPORATION, Göteborg (SE)

( * ) Notice: Subject to any disclaimer, the term of this patent is extended or adjusted under 35 U.S.C. 154(b) by 41 days.

(21) Appl. No.: 15/772,400

(22) PCT Filed: Nov. 4, 2015

(86) PCT No.: PCT/EP2015/075715

§ 371 (c)(1),
(2) Date: Apr. 30, 2018

(87) PCT Pub. No.: WO2017/076444

PCT Pub. Date: May 11, 2017

(65) Prior Publication Data

US 2018/0313254 A1 Nov. 1, 2018

(51) Int. Cl.

| | |
|---|---|
| ***F01P 9/00*** | (2006.01) |
| ***F01P 7/16*** | (2006.01) |
| ***F01P 3/02*** | (2006.01) |
| *F01P 7/14* | (2006.01) |

(52) U.S. Cl.

CPC ..... *F01P 7/167* (2013.01); *F01P 3/02* (2013.01); *F01P 2003/021* (2013.01); *F01P 2007/146* (2013.01); *F01P 2025/33* (2013.01); *F01P 2031/30* (2013.01); *F01P 2050/24* (2013.01)

(58) Field of Classification Search

CPC .... F01P 7/167; F01P 11/00; F01P 7/16; F01P 2007/146; F01P 1/02; F01P 11/10

USPC ..... 123/41.01, 41.02, 41.05, 41.08

See application file for complete search history.

(56) References Cited

U.S. PATENT DOCUMENTS

| | | | | |
|---|---|---|---|---|
| 5,159,910 | A | 11/1992 | Ninomiya et al. | |
| 9,581,072 | B2 * | 2/2017 | Hutchins | F01P 3/20 |
| 10,337,389 | B2 * | 7/2019 | Quix | |
| 2002/0053325 | A1 | 5/2002 | Fishman et al. | |
| 2004/0069546 | A1 | 4/2004 | Lou et al. | |
| 2004/0163861 | A1 | 8/2004 | Fukuda et al. | |
| 2005/0028756 | A1 | 2/2005 | Santanam et al. | |
| 2006/0216166 | A1 * | 9/2006 | Pawellek | F01P 5/10 417/371 |
| 2010/0050960 | A1 | 3/2010 | Araki et al. | |
| 2011/0246007 | A1 | 10/2011 | Choi et al. | |
| 2012/0138696 | A1 | 6/2012 | Ryu | |

(Continued)

FOREIGN PATENT DOCUMENTS

| | | | |
|---|---|---|---|
| CN | 103867283 | A | 6/2014 |
| DE | 10234087 | A1 | 2/2004 |

(Continued)

OTHER PUBLICATIONS

International Search Report (dated Dec. 2, 2015) for corresponding International App. PCT/EP2015/075715.

*Primary Examiner* — John Kwon

(74) *Attorney, Agent, or Firm* — Venable LLP; Jeffri A. Kaminski

(57) ABSTRACT

A method is provided for operating an internal combustion engine (ICE), typically together with a vehicle. A corresponding ICE and a related computer program product are also provided.

14 Claims, 3 Drawing Sheets

(56) References Cited

U.S. PATENT DOCUMENTS

| | | | | |
|---|---|---|---|---|
| 2013/0263802 | A1 | 10/2013 | Lee et al. | |
| 2014/0034741 | A1 | 2/2014 | Schwartz et al. | |
| 2016/0363101 | A1* | 12/2016 | Maucher | F02M 26/22 |
| 2017/0037777 | A1* | 2/2017 | Bellinger | F01P 3/20 |
| 2017/0159548 | A1* | 6/2017 | Richter | F01P 7/14 |
| 2018/0053950 | A1* | 2/2018 | Buehler | H01M 8/04029 |

FOREIGN PATENT DOCUMENTS

| | | | |
|---|---|---|---|
| EP | 0894954 | A1 | 2/1999 |
| EP | 1998021 | A2 | 12/2008 |
| JP | 2001317656 | A | 11/2001 |
| JP | 2010089718 | A | 4/2010 |
| JP | 201114930 | A | 8/2011 |

* cited by examiner

METHOD OF OPERATING AN INTERNAL COMBUSTION ENGINE

BACKGROUND AND SUMMARY

The invention relates to a method of operating an internal combustion engine (ICE), typically comprised with a vehicle. The invention also relates to a corresponding ICE and to a thereto related computer program product.

In operating an internal combustion engine (ICE) of a vehicle, a considerable amount of heat is generated, heat that must be efficiently dissipated to prevent damage to the ICE. This is generally accomplished by a coolant-based cooling circuit, in which a pump circulates coolant through tubes in a radiator. Air cools the tubes and hence the coolant, and the coolant is then pumped through various components of the ICE, including the combustion chamber of the ICE, thereby cooling the ICE.

In a cold start phase of the ICE, it is typically desirable to allow the temperature of a combustion chamber of the ICE to rapidly increase to be within an ideal operating temperature range, thereby reducing fuel consumption and gas emission. This is in the cold start phase achieved by suppressing the flow of the coolant by using a temperature controlled valve, such as a thermostat, arranged with the cooling circuit. During the flow suppression, the valve is at least partly arranged in a closed state. Once the temperature of the combustion chamber has increase and reached a predetermined threshold, the valve is arranged in an open state and the coolant is allowed to flow freely through the cooling circuit.

With the advance of new vehicle types and method for controlling a vehicle, there will exist scenarios where the above mentioned type of temperature based control of the ICE cooling is counter-productive. Specifically, there is a desire to adapt such a cooling circuit to allow for further reduction in fuel consumption and to minimize the emission produced by the ICE.

According to an aspect of the invention, the above is at least partly alleviated by a method of operating an internal combustion engine (ICE), the ICE comprising a combustion chamber, a cooling circuit, the cooling circuit including a liquid cooling passage arranged in proximity of the combustion chamber, wherein a coolant is arranged to flow within the cooling circuit, and a first valve arranged with the cooling circuit, the first valve arranged to control the flow of the coolant flowing through the liquid cooling passage, wherein the method comprises the steps of determining an operational state of the ICE, and controlling the first valve based on the operational state of the ICE, wherein the first valve is controlled to be in an at least partly closed state if the ICE is in an inoperative state, thereby reducing the flow of the coolant flowing through the liquid cooling passage.

In accordance to the invention, it will be possible to control a temperature reduction rate of the combustion chamber of ICE, such that the time it takes for walls of the combustion chamber to cool down is increased. In a prior art solution where no flow suppression is present when the ICE is in the inoperative state, the coolant can continue to flow due to the principles of thermosiphon, a physical effect allowing passive heat exchange based on natural convection. In fact, this is valid despite that a coolant pump comprised with the cooling circuit is inactive, as long as the temperature of the combustion chamber is above a predetermined temperature for a thermostat typically comprised with the cooling circuit (i.e. the thermostat is in the open state). According to the thermosiphon principles, convective movement of a liquid starts when liquid in the loop is heated, causing it to expand and become less dense, and thus more buoyant than the cooler liquid in the bottom of the loop. Convection moves the heated liquid upwards in the system as it is simultaneously replaced by cooler liquid returning by gravity. In a typical cooling system, the coolant will be cooled down within a radiator comprised with the cooling system (when exposed to ambient air) and continue to circulate even when the ICE is turned off/in the inoperational state.

The inventive concept will in comparison to prior art solutions allow the temperature of the combustion chamber to be kept higher for a longer time period during inoperation of the ICE by controlling the first valve, thereby allowing the temperature of the combustion chamber to have a temperature being closer to an ideal operational temperature range of the combustion chamber once the ICE again is set to its operational state (as compared to a prior-art implementation). Consequently, the ICE may be more efficiently operated already from the start, hence possibly lowering the energy consumption for the ICE. For example, in an implementation where the ICE is operated in a continuous alternation between its operational and inoperational state, the temperature of the walls of the combustion chamber may be kept "as high as possible" also during the inoperation of the ICE, such that the ICE more quickly again may reach its ideal operational temperature range.

In a possible implementation of the invention, a unit for selective catalytic reduction (SCR) is provided with the ICE for reducing particulate emission, where the SCR need to be kept at a relative high operational temperature for operating adequately. In a corresponding manner as discussed above, the SCR will benefit from an in comparison higher temperature of the combustion chamber once the ICE is again entering the operational state. Thus, the inventive concept allows for the SCR more quickly reaching its operational temperature and hence allows for a further reduction of gas emissions (e.g. NOx).

In addition, as the temperature of the combustion chamber may be kept in comparison high, the inventive concept may remove the necessity of using electrical pre-heating measures for increasing the temperature of the combustion chamber when the ICE is again set in its operational state. It should be understood that other methods may be applied for pre-heating, including for example a fuel based solution as is known in the art.

The first valve may be an electrically controllable valve, possibly comprised with a thermostat provided with the cooling circuit. It may also be possible, and within the scope of the invention, to allow the first valve to be provided as an additional component in addition to an already available prior art thermostat (e.g. as an upgrade procedure). It should be noted that the first valve as an alternative may be similarly controlled in a pneumatic or hydraulic manner.

According to a preferred embodiment, the method further comprises the steps of receiving an indication of an upcoming inoperation of the ICE and controlling the first valve to be in the at least partly closed state a time period prior to the upcoming inoperation of the ICE. For example, the ICE may be arranged to operate a generator provided for charging an energy storage device, such as a battery. In such an implementation a current state of charge, SoC, of the battery as compared to a desired charging level may be used in for making a determination/prediction of when the ICE is expected to shut down, i.e. due to the SoC having reached the desired charging level. In a further example, the operation of the ICE may be "pre-planned", for example in a hybrid implementation as will be further discussed below The temperature of the walls of the combustion chamber will increase as a consequence of closing the first valve prior to shutting down the ICE, possibly above the ideal operational temperature range. However, this will also give a higher starting temperature once the ICE is entering its inoperational state. Thereby, when the ICE is again activated some time later, the temperature of the walls of the combustion chamber may be even slightly higher; further reducing the time it takes to again reach the ideal operational temperature range.

In a possible embodiment of the invention, the method may also comprise the steps of determining a temperature of the combustion chamber, and comparing the temperature of the combustion chamber with a predetermined threshold, wherein the first valve is controlled to be in the at least partly closed state if the temperature of the combustion chamber is below the predetermined threshold. Accordingly, in case the temperature is determined to be "too high", the flow suppression may be slightly postponed until the temperature is below the predetermined threshold. This conditioning of controlling the first valve is advantageous as it reduces the risk of overheating the ICE.

The total duration for controlling the first valve in the at least partly closed state may be dependent on an expected duration for the ICE being in its inoperative state. For example, if the duration for the expected inactivity is longer than a predetermined time period, such that the temperature of the chamber walls at the end of the time period is determined to be close to an ambient temperature, it may instead be advantageous to keep the first valve in the open state also during the inoperative of the ICE. Furthermore, the expected duration for inoperation of the ICE may as an alternative be used in the determination of how early prior to the inoperation of the ICE that the first valve should be at least partly closed.

According to another aspect of the present invention there is provided an ICE, comprising a combustion chamber, a cooling circuit, the cooling circuit including a liquid cooling passage arranged in proximity of the combustion chamber, wherein a coolant is arranged to flow within the cooling circuit, and a first valve arranged with the cooling circuit, the first valve arranged to control the flow of the coolant flowing through the liquid cooling passage, wherein the first valve is adapted to be controllable to an at least partly closed state in dependence of an indication of the ICE being inoperative. This aspect of the invention provides similar advantages as discussed above in relation to the previous aspect of the invention.

In a preferred embodiment of the invention, the ICE is comprised as a component of a power system, the power system for example being a vehicle. The vehicle could for example be a truck or a car. However, the ICE could also be comprised with construction equipment, etc. It should however be understood that the ICE could be provided in a stationary arrangement, such as for example an electrical power station (e.g. Genset). The ICE could for example be a diesel engine or an Otto engine, or a hybrid in between.

The ICE could also be arranged as a component of a hybrid system, such as a hybrid vehicle. It should be noted that a vehicle is not necessary limited to a land based vehicle, rather also marine applications (e.g. a boat) are possible and within the scope of the invention.

When the ICE is comprised with a vehicle, the inventive concept could for example be applicable in situations where a start-stop concept is implemented. In such an implementation, the ICE is typically turned off when the vehicle is stationary (e.g. red light). Consequently, in such a situation the first valve may be controlled to also be in the at least partly closed state, thereby allowing the temperature of the chamber walls to only decrease slightly during the stop period for the vehicle.

In another embodiment, where the ICE is comprised with a hybrid vehicle, an upcoming transition from propelling the vehicle using the ICE to using the electrical motor may form a basis for the indication of the upcoming inoperational state of the ICE. Such a transition may for example depend on the topography for a road where the hybrid vehicle is travelling, e.g. based on a pre-planning for propelling the hybrid vehicle. For example, if the ICE is used to propel the vehicle in an uphill scenario, the first valve could be controlled to be at least partly closed a set time period prior to reaching the top of the hill. As mentioned above, the temperature of the chamber walls will as a consequence increase, possibly above the ideal operational temperature range. The exact time for at least partly closing the first valve prior to reaching the top of the hill may thus be selected such that a difference between the ideal operational temperature range for the ICE and the actual temperature of the chamber walls is minimized once the ICE again is arranged in its operational state.

According to a still further aspect of the present invention there is provided a computer program product comprising a computer readable medium having stored thereon computer program means for operating an ICE, the ICE comprising a combustion chamber, a cooling circuit, the cooling circuit including a liquid cooling passage arranged in proximity of the combustion chamber, wherein a coolant is arranged to flow within the cooling circuit, and a first valve arranged with the cooling circuit, the first valve arranged to control the flow of the coolant flowing through the liquid cooling passage, wherein the computer program product comprises code for determining an operational state of the ICE, and code for controlling the first valve based on the operational state of the ICE, wherein the first valve is controlled to be in an at least partly closed state if the ICE is in an inoperative state, thereby reducing the flow of the coolant flowing through the liquid cooling passage. Also this aspect of the invention provides similar advantages as discussed above in relation to the previous aspects of the invention.

The computer readable medium may be any type of memory device, including one of a removable nonvolatile random access memory, a hard disk drive, a floppy disk, a CD-ROM, a DVD-ROM, a USB memory, an SD memory card, or a similar computer readable medium known in the art.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION

Figure 1A:
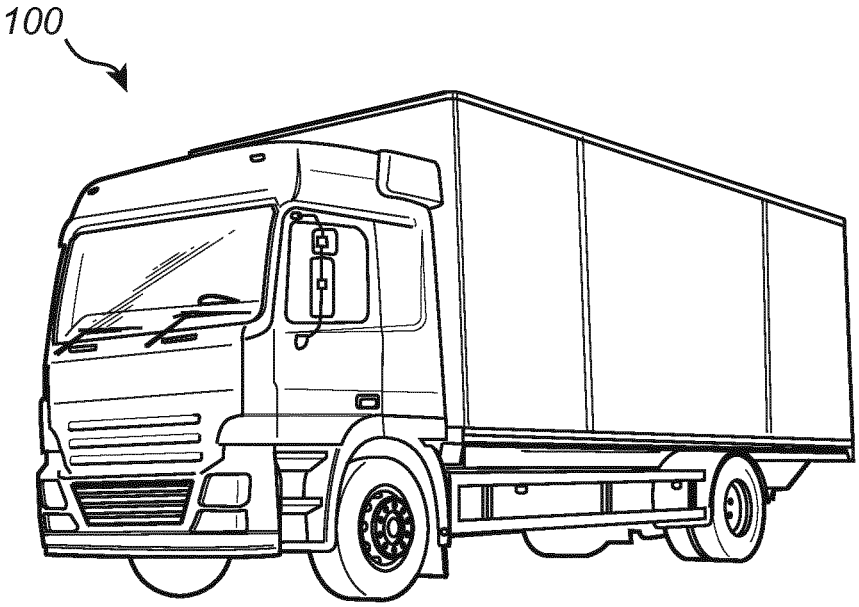
FIGS. 1A and 1B illustrate different types of vehicles equipped with an adaptive cooling mechanism according to the inventive concept.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Figure 1B:
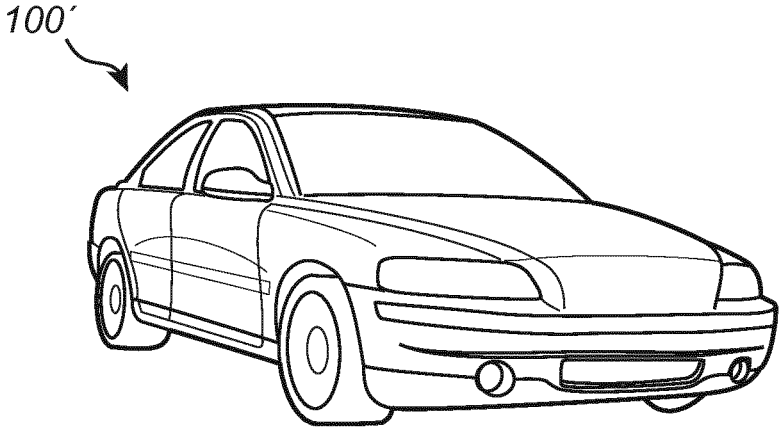

Referring now to the drawings and to FIGS. 1A and 1B in particular, there is in FIG. 1A depicted an exemplary vehicle, here illustrated as a truck 100, in which the adaptive cooling mechanism according to the present invention may be incorporated. The inventive concept may of course also be implemented, possibly in a slightly different way, in a car 100', as shown in FIG. 1B.

Figure 2:
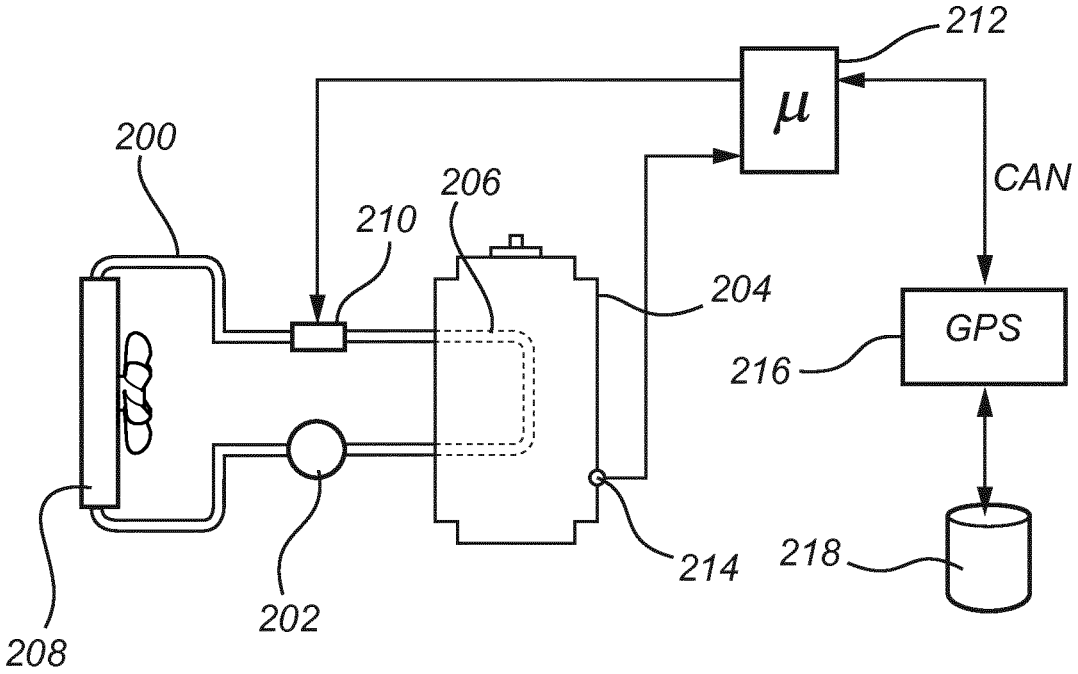
FIG. 2 shows a cooling circuit for an internal combustion chamber adapted to be controlled in accordance to the inventive concept.

As shown in FIG. 2, there is provided a cooling circuit 200 for an internal combustion engine (ICE). The cooling circuit 200 comprises a coolant pump 202 forcing coolant to circulate through the cooling circuit 200. The coolant pump 202 is disposed between an engine body 204 of the ICE, having a cooling passage 206 through a cylinder block and a cylinder head at the combustion chamber, and a radiator 208 that irradiates heat of the engine body that has been absorbed by the coolant to the ambient atmosphere, possibly assisted by a fan.

A first valve 210, in the illustrated implementation being an electrically controllable valve, is provided with the cooling circuit 200; the first valve 210 adjustably arranged to open and close the cooling passage 206 connecting the radiator 208 and the coolant pump 202 depending on an operational state of the ICE. As mentioned above, the first valve 210 may alternatively be controlled for example pneumatically or hydraulically. In addition to the above, a control unit 212 is connected to and provided for controlling the operation of first valve 210. Still further, a temperature sensor 214 is arranged at or in the vicinity of the engine body 204 for measuring a temperature of the combustion chamber and providing the same to the control unit 212. The temperature sensor 214 may alternatively (or also) be arranged to measure the temperature of the coolant. It should be understood that first valve 210 could be adjustably controlled to be 0-100% open, e.g. depending on the temperature measured by the temperature sensor 214. However, it should be understood that the temperature also may be measured using a "virtual temperature sensor", where the temperature is e.g. determined based on the operation of the ICE.

The control unit 212 may also be connected to e.g. a communication interface (such as e.g. a CAN bus or similar, or a dedicated communication interface). Further components may be connected to the control unit 202, including for example arrangements for determination of the position of for example the truck 100 as shown in FIG. 1, such as for example a GPS (global positioning system, or similar) arrangement 216, combined with a database 218 storing map information, e.g. allowing e-horizon data to be stored with the truck 100. The maple-horizon data may comprise information relating to for example, type of road, and number of traffic lanes, topography for the road, and/or any static obstacles on the road.

The control unit 212 may include a general purpose processor, an application specific processor, a circuit containing processing components, a group of distributed processing components, a group of distributed computers configured for processing, etc. The processor may be or include any number of hardware components for conducting data or signal processing or for executing computer code stored in memory. The memory may be one or more devices for storing data and/or computer code for completing or facilitating the various methods described in the present description. The memory may include volatile memory or non-volatile memory. The memory may include database components, object code components, script components, or any other type of information structure for supporting the various activities of the present description. According to an exemplary embodiment, any distributed or local memory device may be utilized with the systems and methods of this description. According to an exemplary embodiment the memory is communicably connected to the processor (e.g., via a circuit or any other wired, wireless, or network connection) and includes computer code for executing one or more processes described herein. The control unit 212 may be provided as a separate unit and/or may at least partly form part of an electronic control unit comprised with the truck 100.

Figure 3:
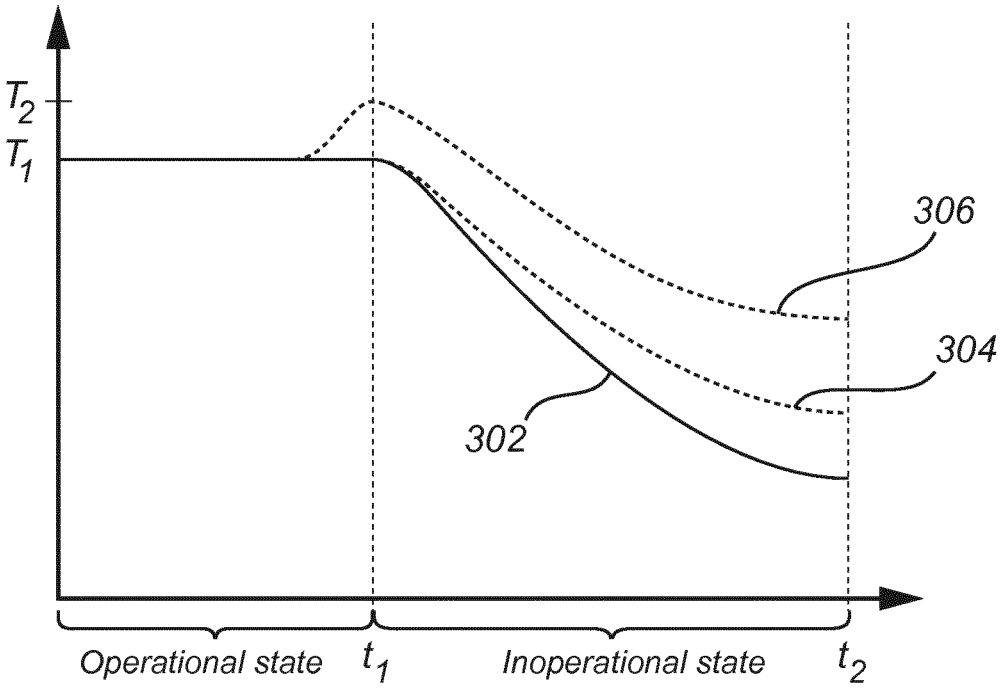
FIG. 3 is a diagram conceptually illustrating the temperature of an ICE during its different operational stages, and FIG. 4 conceptually illustrates the processing steps for performing the method according to the invention.
Figure 4:
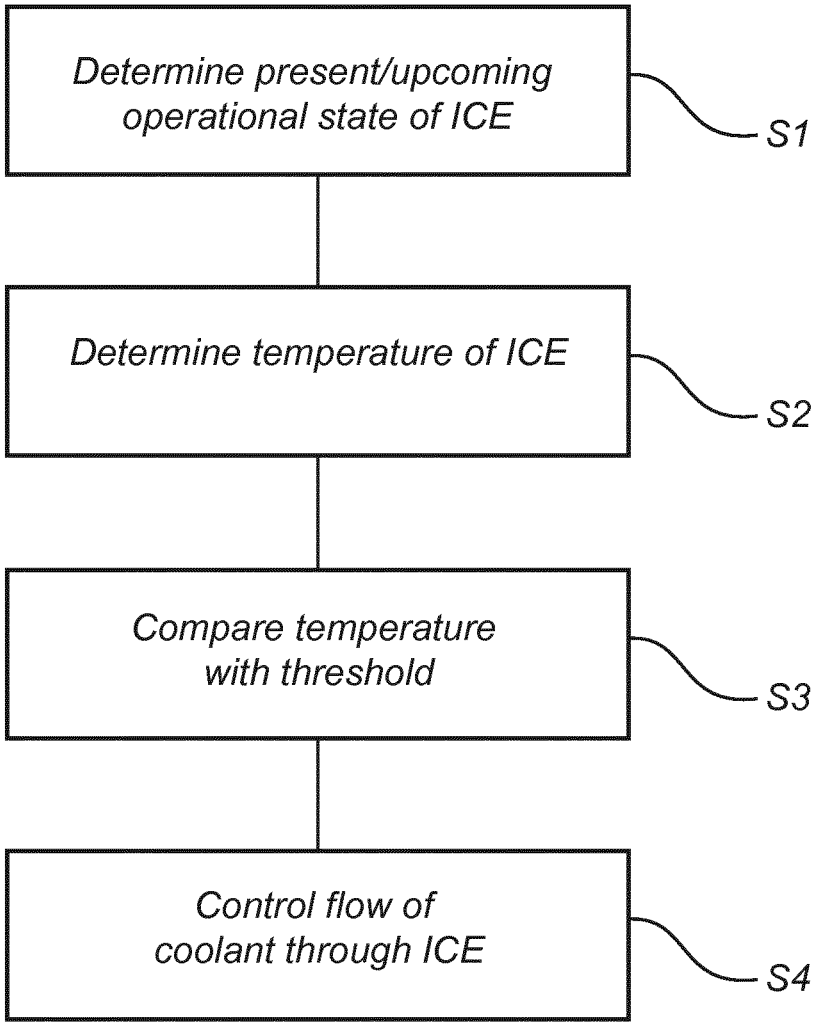

During operation of the inventive cooling mechanism, with further reference to FIGS. 3 and 4, the process starts by that the control unit 202 collects/receive information relating to the operation of the truck 100, and of the ICE in particular. Such information typically includes, as indicated above, a temperature of the combustion chamber and/or a temperature of the coolant circulating within the cooling circuit 200. In addition, the control unit 212 may receive GPS and map data from the GPS receiver 216 and database 218.

Based on the collected/received operational information, the control unit 212, determines, S1, at least one of a present and an upcoming operational state of the ICE. As was indicated above, the state of the ICE is typically either one of an operational state where the ICE is e.g. actively propelling the truck 100 (and/or alternatively used for charging a battery), or an inoperational state where the ICE is shut off. The determination of a present inoperation is fairly straight forward, while the determination/prediction of an upcoming inoperational state of the ICE may be more complicated.

As an example, in a hybrid truck (not explicitly illustrated) where the ICE according to the invention is provided as a component alongside an electric motor powered by a battery, the control unit 212 (or a further electronic control unit, ECU, provided with the truck) may be used for determining an operational split between the ICE and the electrical motor. The operational split may be dependent on a planned route for the hybrid truck, possibly topographical data for the planned route. In such an implementation the control unit 212/ECU may have a detailed plan on when the ICE is operational and inoperational. This information could consequently be used also for determining when and how the first valve 210 should be controlled.

Other situations exist, also for a general truck, i.e. not being a hybrid truck. One example may for example be the mentioned topography of a road, where the knowledge of an upcoming downhill section of the road together with a speed of the truck 100 may be used for predicting an inoperational state of the ICE. That is, during the downhill section of the road the ICE may be selected to be inoperational, as the inclination of the road together with a weight of the truck 100 may be sufficient for achieving a desirable speed also during the downhill section. Still further, general trip planning could be used for predicting a future inoperational state of the ICE. For example, predefined stops (geographical locations) for a delivery truck may be used for predicting the upcoming inoperational of the ICE, e.g. defined as a set distance from one of the predefined stops, typically together with information from the GPS arrangement 216.

As mentioned above, the control unit 212 is also configured to determine, S2, a temperature of the combustion chamber (or similar) and to compare, S3, the measured temperature with a predetermined threshold. Specifically, the temperature (in comparison to the threshold) is advantageously used for determining how the first valve 210 should be controlled, to ensure that the temperature of the combustion chamber is kept safely within specified temperature limits for ICE operation. It should be noted that it may exist further situations where the first valve 210 should be refrained from being arranged in its (at least partly) closed state. Accordingly, it may be advantageous to implement an "override" functionality allowing the presented operation of the first valve 210 to be controlled on "a higher level". For example, in case a further component of the ICE (i.e. further to the combustion chamber) is in need of a flowing coolant, the arranging the first valve 210 may be disadvantageous. Thus, the control unit 212 may be arranged to implement such override functionality and collect/process data for performing the same in a suitable manner.

FIG. 3 provides three examples of how the temperature of the combustion chamber will depend on how and if the first valve 210 is controlled. In a first example, typically a prior-art implementation where the inventive concept is not applied, the coolant is allowed to flow freely through the cooling passage 206, according to the thermosiphon principles, also during the inoperational state of the ICE. As can be seen in FIG. 3, the combustion chamber is kept at an ideal operational temperature T1 (exemplified and within the mentioned ideal operational temperature range) as long as the ICE is in its operational state (i.e. turned on). Once the ICE is switched off and thus inoperational, at time t1, the temperature of the combustion chamber and the coolant flowing through the cooling circuit 200 will decrease as exemplified by the solid line 302. At time t2 the temperature of the coolant/ICE has reached a temperature below the ideal operational temperature T1.

In accordance to the invention and in a second example, by the determination made by the control unit 212 and as elaborated above, the flow of the coolant flowing through the cooling circuit 200 and specifically through the cooling passage 206 within the engine body 204, may be controlled, S4, using the first valve 210. As exemplified by the dotted line 304 in FIG. 3, the control unit 212 has determined that the temperature of the combustion chamber is below the predetermined threshold and that the ICE is entering the inoperational state, specifically at time t1. Thus, the flow of the coolant is at least partly reduced, possibly completely shut off. That is, the control of the first valve 210 to the at least partly closed state will partly or completely counteract the thermosiphon principles. The temperature of the combustion chamber will still decrease, however at a lower rate as compared to the prior-art situation previously illustrated by solid line 302. Accordingly, at time t2, the temperature of the combustion chamber will be higher as compared to temperature for the prior art situation and as exemplified by line 302.

In a third example, the control unit 212 has predicted an upcoming inoperational state of the ICE as explained above. Accordingly, the first valve 210 is controlled to reduce the flow of the coolant through the cooling passage 206 already prior to the inoperational state of the ICE, i.e. prior to time t1. This will result in an increase of the temperature of the combustion chamber from the ideal temperature T1 to a higher temperature T2, still being below the predefined temperature threshold as discussed above. As illustrated by dotted line 306, the temperature of the combustion chamber will thus have a higher temperature T2 at time t1 (as compared to T1) once the ICE enters the inoperational state. Accordingly, if the flow through the cooling passage 206 is continuously controlled to be reduced during the inoperational state of the ICE, the temperature of the combustion chamber will be higher at time t2 as compared to both the first and second examples as indicated by lines 302 and 304.

It should be noted that the ideal operational temperature T1 for the combustion chamber as illustrated in FIG. 3 is just an example. The ideal operational temperature for the combustion chamber may be set differently, and is typically defined as to be within a defined range, possibly based on different load cases for the ICE. Furthermore, the ideal operational temperature for the ICE must not necessarily be a constant temperature; rather the temperature may be allowed to fluctuate. Accordingly, the disclosed method for controlling the ICE should preferably be implemented with this in mind for maximizing the increase performance made possible with the inventive concept.

In summary, the present invention relates to a method of operating an internal combustion engine (ICE), the ICE comprising a combustion chamber, a cooling circuit, the cooling circuit including a liquid cooling passage arranged in proximity of the combustion chamber, wherein a coolant is arranged to flow within the cooling circuit, and a first valve arranged with the cooling circuit, the first valve arranged to control the flow of the coolant flowing through the liquid cooling passage, wherein the method comprises the steps of determining an operational state of the ICE, and controlling the first valve based on the operational state of the ICE, wherein the first valve is controlled to be in an at least partly closed state if the ICE is in an inoperative state, thereby reducing the flow of the coolant flowing through the liquid cooling passage.

Advantages with the invention includes the possibility of effectively controlling the cooling temperature of the combustion chamber when the ICE is or is about to enter an inoperative state. The inventive concept will in comparison to other prior art solutions allow the temperature of the combustion chamber to be kept higher for a longer time period, allowing the temperature of the combustion chamber to have a temperature being closer to an ideal operational temperature of the combustion chamber once the ICE again is operating. Consequently, the ICE may be more efficiently operated already from the start, hence possibly lowering energy consumption and particulate emission.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor.

By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps. Additionally, even though the invention has been described with reference to specific exemplifying embodiments thereof, many different alterations, modifications and the like will become apparent for those skilled in the art.

Variations to the disclosed embodiments can be understood and effected by the skilled addressee in practicing the claimed invention, from a study of the drawings, the disclosure, and the appended claims. Furthermore, in the claims, the word "comprising" does not exclude other elements or steps, and the indefinite article "a" or "an" does not exclude a plurality.

The invention claimed is:

1. A method of operating an internal combustion engine (ICE), the ICE comprising:

a combustion chamber;

a cooling circuit, the cooling circuit including a liquid cooling passage arranged in proximity of the combustion chamber, wherein a coolant is arranged to flow within the cooling circuit; and a first valve arranged with the cooling circuit, the first valve arranged to control the flow of the coolant flowing through the liquid cooling passage, the method comprising:

determining an operational state of the ICE, and controlling the first valve based on the operational state of the ICE, wherein the first valve is controlled to be in an at least partly closed state prior to a predicted upcoming inoperative state for the ICE in which the ICE is expected to shut down, the at least partly closed state reducing the flow of the coolant flowing through the liquid cooling passage.

2. The method according to claim 1, further comprising:

determining a temperature of the combustion chamber, and comparing the temperature of the combustion chamber with a predetermined threshold, wherein the first valve is controlled to be in the at least partly closed state if the temperature of the combustion chamber is below the predetermined threshold.

3. The method according to claim 1, wherein the ICE is configured to operate a generator configured to charge an energy storage device, and the indication of the inoperation of ICE is based on a state of charge for the energy storage device.

4. The method according to claim 1, further comprising:

determining an expected duration for the ICE being in the inoperative state; and controlling a level of closure of the first valve based on the expected duration.

5. An internal combustion engine (ICE), comprising:

a combustion chamber;

a cooling circuit, the cooling circuit including a liquid cooling passage arranged in proximity of the combustion chamber, wherein a coolant is arranged to flow within the cooling circuit; and a first valve arranged with the cooling circuit, the first valve arranged to control the flow of the coolant flowing through the liquid cooling passage, wherein the first valve is adapted to be controllable to an at least partly closed state when receiving an indication of an upcoming inoperation of the ICE based on a prediction of when the ICE is expected to be shut down, the at least partly closed state reducing the flow of the coolant flowing through the liquid cooling passage a determined time period prior to the expected shut down of the ICE.

6. The ICE according to claim 5, wherein the operation of the first valve is further dependent on a temperature of the combustion chamber.

7. The ICE according to claim 5, wherein the ICE is configured to operate a generator configured to charge an energy storage device, and the indication of the inoperation of ICE is based on a state of charge for the energy storage device.

8. The ICE according to claim 5, wherein the first valve is included in a thermostat comprised with the cooling circuit.

9. The ICE according to claim 5, wherein the first valve is an electrically controllable valve.

10. The ICE according to claim 5, wherein the level of closure of the first valve is dependent on an expected duration of inoperation of the ICE.

11. A power system, comprising:

an ICE according to claim 5.

12. The power system according to claim 11, further comprising:

an electric motor; and a control unit configured to control and selectively operate the ICE and the electric motor.

13. The power system according to claim 11, wherein the power system is at least one of a vehicle and a stationary arrangement.

14. A computer program product comprising a computer readable medium having stored thereon computer program means for operating an internal combustion engine (ICE), the ICE comprising a combustion chamber, a cooling circuit, the cooling circuit including a liquid cooling passage arranged in proximity of the combustion chamber, wherein a coolant is arranged to flow within the cooling circuit, and a first valve arranged with the cooling circuit, the first valve arranged to control the flow of the coolant flowing through the liquid cooling passage, wherein the computer program product comprises:

a program for determining an operational state of the ICE; and a program for controlling the first valve based on the operational state of the ICE, wherein the first valve is controlled to be in an at least partly closed state for a determined time period prior to a predicted upcoming inoperative state for the ICE in which the ICE is expected to be shut down, the at least partly closed state reducing the flow of the coolant flowing through the liquid cooling passage.

* * * * *